US011105102B2

(12) United States Patent
Bunch et al.

(10) Patent No.: US 11,105,102 B2
(45) Date of Patent: Aug. 31, 2021

(54) LEVELING CLIP AND TILE LEVELING DEVICE FOR USE OF SAME

(71) Applicants: Clinton D. Bunch, Keller, TX (US); Joshua A. Bunch, Keller, TX (US)

(72) Inventors: Clinton D. Bunch, Keller, TX (US); Joshua A. Bunch, Keller, TX (US)

( * ) Notice: Subject to any disclaimer, the term of this patent is extended or adjusted under 35 U.S.C. 154(b) by 0 days.

(21) Appl. No.: 17/090,584

(22) Filed: Nov. 5, 2020

(65) Prior Publication Data

US 2021/0131124 A1 May 6, 2021

Related U.S. Application Data

(60) Provisional application No. 62/930,632, filed on Nov. 5, 2019.

(51) Int. Cl.
*E04F 21/22* (2006.01)
*E04F 13/08* (2006.01)
*E04F 21/00* (2006.01)

(52) U.S. Cl.
CPC ..... *E04F 21/22* (2013.01); *E04F 13/0892* (2013.01); *E04F 21/0092* (2013.01)

(58) Field of Classification Search
CPC ... E04F 21/0092; E04F 21/22; E04F 21/1844; E04F 21/1877; E04F 13/0892; E04F 15/02005
See application file for complete search history.

(56) References Cited

U.S. PATENT DOCUMENTS 4,397,125 A 8/1983 Gussler
7,603,825 B2 10/2009 Dohren
7,621,100 B2 11/2009 Kufner et al.
7,861,487 B2 1/2011 Kufner et al.
7,954,300 B1 6/2011 Kufner et al.
7,992,354 B2 8/2011 Doda, Jr.
8,181,420 B2 5/2012 Comas
9,260,872 B2 2/2016 Bunch et al.
9,487,959 B2 11/2016 Bunch et al.
(Continued)

FOREIGN PATENT DOCUMENTS

AU 2012101175 8/2012
EP 3584389 A1 * 12/2019 ..... E04F 15/02022
(Continued)

OTHER PUBLICATIONS

Pearl Abrasive Co., Tuscan Leveling System, www.pearlabrasive.com.
(Continued)

*Primary Examiner* — Babajide A Demuren
(74) *Attorney, Agent, or Firm* — Scott Griggs; Griggs Bergen LLP

(57) ABSTRACT

A leveling clip and tile leveling device for use of the same are disclosed. In one embodiment, the leveling clip includes a body defining an opening that is configured to accept a wedge device thereat. Tapered legs extend from the body and join a base at a base to body coupling. The base extends to a front and a rear of the body. The base to body coupling includes a frangible breakaway section that is integral prior to frangible separation and the frangible breakaway section, upon breaking, frangibly separates the body from the base. The leveling clip may be used with the wedge device to install two, three, or four tiles.

11 Claims, 7 Drawing Sheets

(56) References Cited

U.S. PATENT DOCUMENTS

| | | | | |
|---|---|---|---|---|
| 9,970,203 | B1 * | 5/2018 | Abidov | E04F 21/0092 |
| 10,047,530 | B2 | 8/2018 | Bunch et al. | |
| 10,513,857 | B2 | 12/2019 | Bunch et al. | |
| 10,704,274 | B2 | 7/2020 | Bunch et al. | |
| 2008/0236094 | A1 * | 10/2008 | Doda | E04F 21/22 52/749.11 |
| 2013/0055675 | A1 * | 3/2013 | Sighinolfi | E04F 15/02022 52/749.11 |
| 2013/0118115 | A1 | 5/2013 | Hoffman et al. | |
| 2014/0033640 | A1 * | 2/2014 | Gorton | E04F 21/0092 52/747.11 |
| 2014/0116001 | A1 * | 5/2014 | Ghelfi | E04F 21/0092 52/749.11 |
| 2014/0298736 | A1 * | 10/2014 | Bunch | E04F 21/0092 52/126.1 |
| 2015/0308130 | A1 * | 10/2015 | Biec | E04F 21/0092 52/749.11 |
| 2019/0169863 | A1 * | 6/2019 | Torrents Comas | E04F 15/02022 |
| 2020/0224434 | A1 * | 7/2020 | Troxell | E04F 21/0092 |
| 2020/0347617 | A1 * | 11/2020 | Troxell | E04F 21/0092 |

FOREIGN PATENT DOCUMENTS

| | | | | |
|---|---|---|---|---|
| WO | 2013033761 | | 3/2013 | |
| WO | WO-2018227250 | A1 * | 12/2018 | E04F 21/0092 |

OTHER PUBLICATIONS

Q.E.P. Co., Inc., Lash Tile Leveling Clips and Wedges, 99720/9972, www.qep.com.

* cited by examiner

LEVELING CLIP AND TILE LEVELING DEVICE FOR USE OF SAME

PRIORITY STATEMENT & CROSS-REFERENCE TO RELATED APPLICATIONS

This application claims priority from U.S. Patent Application Ser. No. 62/930,632 entitled "Leveling Clip and Tile Leveling Device for Use of Same" filed on Nov. 5, 2019, in the names of Clinton D. Bunch and Joshua A. Bunch; which is hereby incorporated by reference, in entirety, for all purposes.

TECHNICAL FIELD OF THE INVENTION

This invention relates, in general, to tile installation and, in particular, to a leveling clip for leveling tiles and a tile leveling device for use of the same that properly levels tiles during the installation thereof.

BACKGROUND OF THE INVENTION

Tile has become a popular, decorative, and functional article for use in floors, walls, countertops, and the like. Both professional tile installers and do-it-yourselfers spend a great deal of time aligning and leveling tiles as they are being placed on a substrate's surface. Proper alignment and leveling of each tile are important for a number of reasons. Improper installation may cause the need for tiles to be replaced in order to prevent a spacing error from propagating across the substrate, for example. Improper installation may also cause impact aesthetics, and in some instances, create safety concerns. A need exists for a leveling clip for leveling tiles and tile leveling device for use of the same that properly spaces tiles during the installation thereof.

SUMMARY OF THE INVENTION

It would be advantageous to achieve a device for leveling and aligning tiles and properly spacing tiles. It would also be desirable to enable a mechanical-based solution that furnishes an inexpensive tool that assists professional tile installers and do-it-yourselfers. To better address one or more of these concerns, in one aspect of the invention, a leveling clip for leveling tiles and a tile leveling device for use of the same are disclosed. In one embodiment of the leveling clip, the leveling clip includes a body defining an opening that is configured to accept a wedge device thereat. Tapered legs extend from the body and join a base at a base to body coupling. The base extends to a front and a rear of the body. The base to body coupling includes a frangible breakaway section that is integral prior to frangible separation and the frangible breakaway section, upon breaking, frangibly separates the body from the base. The leveling clip may be used with the wedge device to install two, three, or four tiles. The tapered legs enhance the release of the leveling clip from a mortar bed after the mortar bed is cured or hardened.

In another aspect, a tile leveling device includes the leveling clip and a wedge device having a backstop member and a wedge member extending from the backstop member. The wedge member includes a tapered surface penetrating the opening of the leveling clip and exerting force against underlying tiles. In still another aspect, a tile leveling device includes a shaft and a locking subassembly that is configured to vertically traverse the shaft, by a sliding action or a screw-action, and exert force against tiles by pressing the tiles against spaced and parallel strip members, similar to the functionality described in previous embodiments. A frangible breakaway section is defined along the shaft, which includes tapered surfaces. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1A:
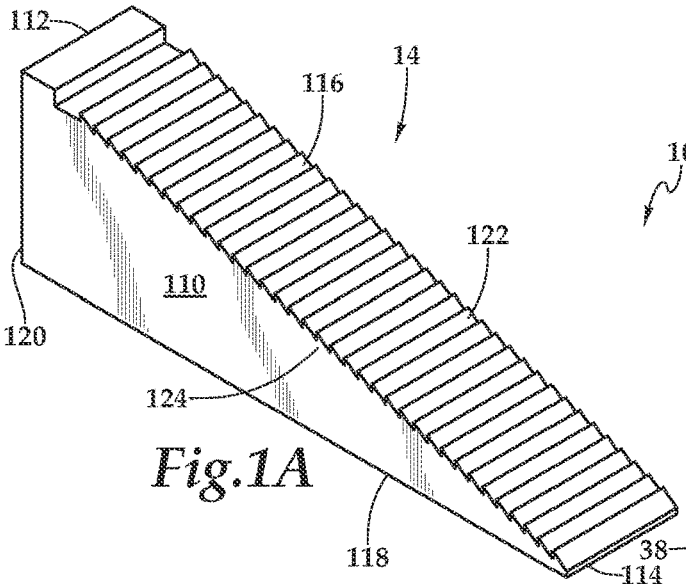
FIGS. 1A and 1B are front perspective views that, when taken together, form one embodiment of a tile leveling device including a leveling clip and a wedge device, according to the teachings presented herein.
Figure 1B:
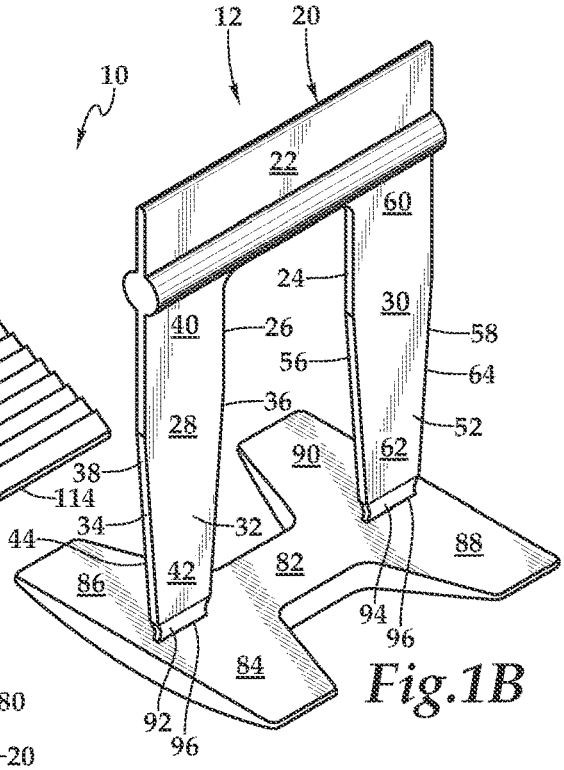
Figure 2:
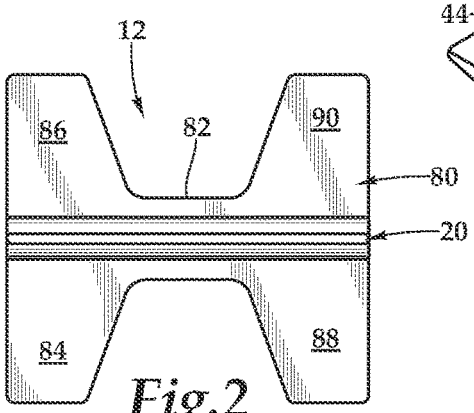
FIG. 2 is a top plan view of the leveling clip depicted in FIG. 1A.
Figure 3:
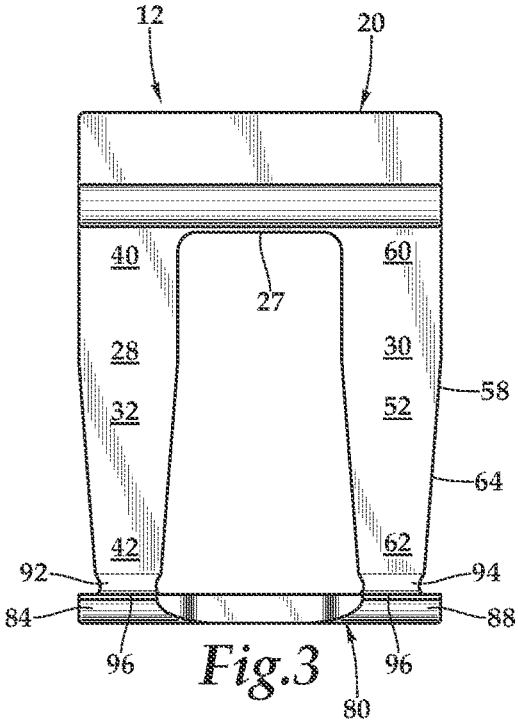
FIG. 3 is a front elevation view of the leveling clip depicted in FIG. 1A.
Figure 4:
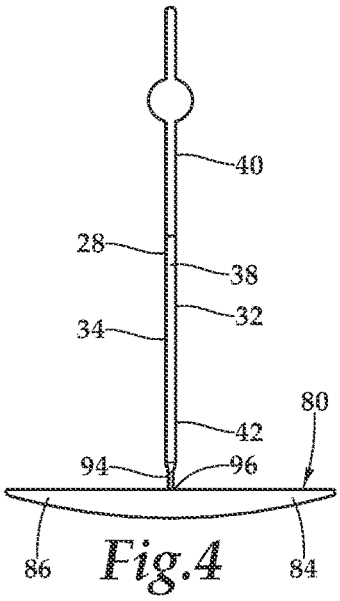
FIG. 4 is a side elevation view of the leveling clip depicted in FIG. 1A.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring initially to FIG. 1A, FIG. 1B, FIG. 2, FIG. 3, and FIG. 4, therein is depicted one embodiment of a tile leveling device schematically illustrated and generally designated 10. The tile leveling device 10 is utilized with a leveling clip 12 and a wedge device 14 to, in combination, align and level two, three, or four tiles, for example. In one embodiment, the leveling clip 12 includes a body 20, which is depicted as an inverted U-shaped body 22 defining an opening 24, having an upper edge 26. The body 20 may have two legs 28, 30 extending therefrom. As shown, in one embodiment, the opening 24 may be positioned proximate the legs 28, 30. The leg 28 includes a front portion 32, a rear portion 34, an inside portion 36, and an outside portion 38. In some embodiments, as shown best in FIG. 3, the front portion 32 presents a thick end 40 and a thin end 42 with a tapered surface 44 therebetween. Similarly, the rear portion 34 presents the thick end 40 and the thin end 42 with the tapered surface 44 therebetween. In some embodiments, as shown best illustrated in FIG. 4 for the outside portion 38, the outside portion 38 is not tapered, and, similarly, the inside portion 36 is not tapered.

The leg 30 similarly includes a front portion 52, a rear portion (not shown), an inside portion 56, and an outside portion 58. In some embodiments, the front portion 52 presents a thick end 60 and a thin end 62 with a tapered surface 64 therebetween. Likewise, the rear portion presents the thick end 60 and the thin end 62 with the tapered surface 64 therebetween. In some embodiments, the outside portion 58 is not tapered, and, similarly, the inside portion 56 is not tapered. It should be appreciated that with the legs 28, 30 having the tapering, that in some embodiments, the inside portions and the outside portions may be tapered with the front portions and the rear portions un-tapered. Further still, both the inside portions and the outside portions as well as the front portions and the rear portions may be tapered. The tapering of the legs 28, 30 enhance the release of the leveling clip 12 from the mortar M, which hardens into a bed as the mortar M cures. In one implementation, the tapering of the legs 28, 30 may begin at the point where the legs 28, 30 of the leveling clip 12 intersect the top edge of the tile, when in use, and the tapering may continue to the two frangible breakaway sections 92, 94. Often, the mortar M will ooze up from the bottom to envelop the a lower portion of the legs 28, 30. The tapering of the legs 28, 30 reduces the contact between the mortar M and the legs 28, 30 to make the release of the leveling clip 12 from the mortar M easier.

A base 80, which is shown as an I-shaped base 82 is orthogonally coupled to the body 20 such that four spaced bars 84, 86, 88, 90 extend transversely from the body 20. Two frangible breakaway sections 92, 94 are defined along the respective two legs 28, 30 of the body 20 and provide a base to body coupling 96. It should be appreciated that although a particular body and base are described and illustrated, the leveling clip 12 presented herein may work with a variety of body and base forms and the body and base forms selected will depend on a number of manufacturing and design considerations.

In one embodiment, the wedge device 14 includes a body 110 having an attachment end 112, a penetrating edge 114, a top 116, and a bottom 118. The attachment end 112 is coupled to a backstop member 120 and the penetrating edge 114 is configured to penetrate the leveling clip 12. The body 110 includes an inclined plane 124 tapering from the attachment end 112 to the penetrating edge 114. Teeth 122 are positioned along the inclined plane 124 in order to latch onto the leveling clip 12 as will be described in further detail hereinbelow. It should be appreciated that although a particular wedge device is described and illustrated, the leveling clip 12 presented herein may work with a variety of wedge devices and the wedge devices selected will depend on a number of manufacturing and design considerations.

Figure 5A:
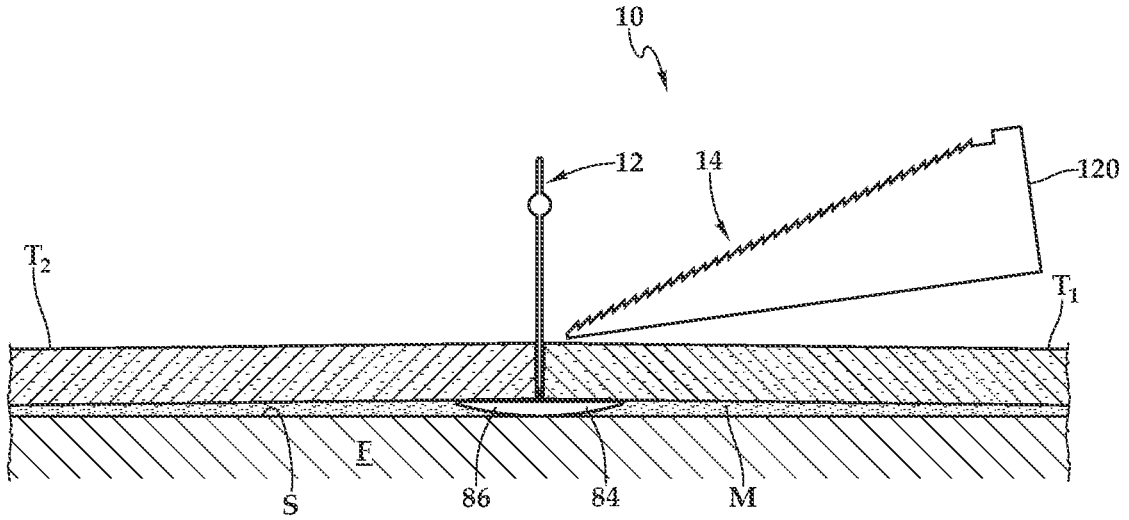
FIG. 5A is a side elevation view, in partial cross-section, of the tile leveling device presented in FIGS. 1A and 1B during installation of tile.
Figure 5B:
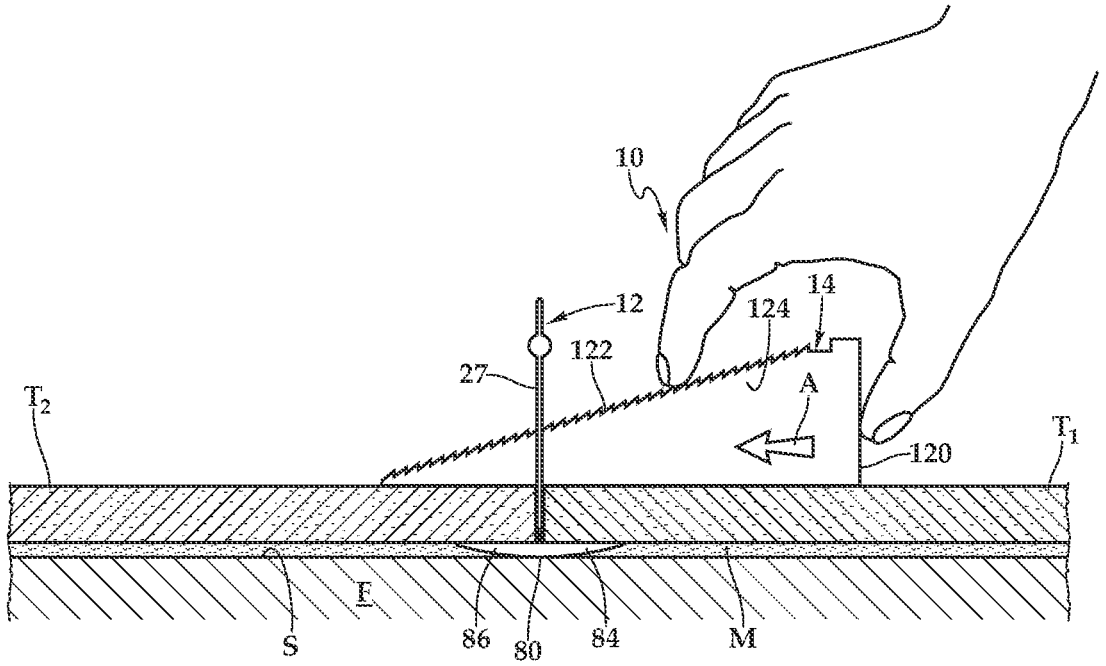
FIG. 5B is a side elevation view, in partial cross-section, of the tile leveling device presented in FIGS. 1A and 1B as the installation of tile progresses.

Referring now to FIG. 5A and FIG. 5B, in one operational implementation, the tile leveling device 10 may be used to align two, three, or four tiles. The leveling clip 12 is positioned on a subsurface, such as a floor F having tile mortar M in space S thereon, and two tiles $T_1$, $T_2$ are placed and positioned thereon. The wedge device 14 is aligned to be inserted into the leveling clip 12. The backstop member 120 of the wedge device 14 provides a push area for fingers or a thumb and an enhanced sized that furnishes more leverage during use. As illustrated in FIG. 5A and FIG. 5B, as the wedge device 14 is inserted in the direction of arrow A, the inclined plane 124 of the wedge device 14 penetrates the opening 24 contacting the upper edge 26 thereof and creating a latch. A finger or a thumb, for example, presses against the backstop member 120 of the wedge device 14 continually driving the wedge device 14 deeper into the leveling clip 12. As the wedge device advances, the resulting force is exerted against tiles $T_1$, $T_2$, pressing the tiles $T_1$, $T_2$, against the base 80 and particularly against spaced bars 84, 86, 88, 90 wherein frangible breakaway sections 92, 94 are located beyond the undersurfaces of the tiles $T_1$, $T_2$ in a direction away from the spaced bars 84, 86, 88, 90. The teeth 122 prevent the wedge device 14 from slipping out of the opening 24 of the leveling clip 12 during penetration thereof. The application of force from the use of the tile leveling device 10 causes the tiles $T_1$, $T_2$ to be level. Following the leveling, the frangible breakaway sections 92, 94 may be broken to remove the wedge device 14 and a portion of the leveling clip 12. With respect to FIG. 5B, as discussed, the tapered legs enhance the release of the leveling clip 12 from the mortar M, which hardens into a bed as the mortar M cures.

Figure 6:
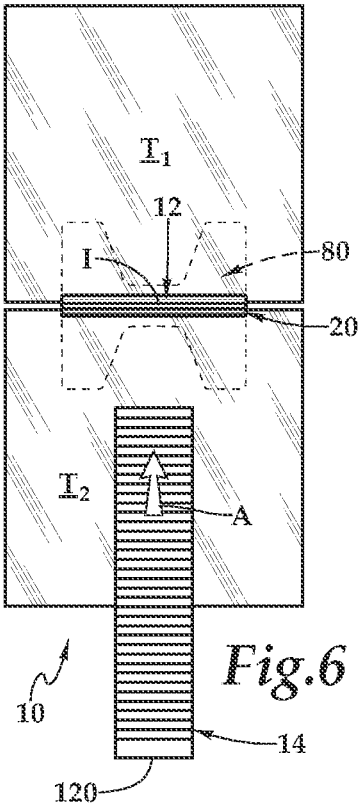
FIG. 6 is a top plan view of the tile leveling device with the leveling clip and wedge device presented in FIGS. 1A and 1B during installation of two tiles.
Figure 7:
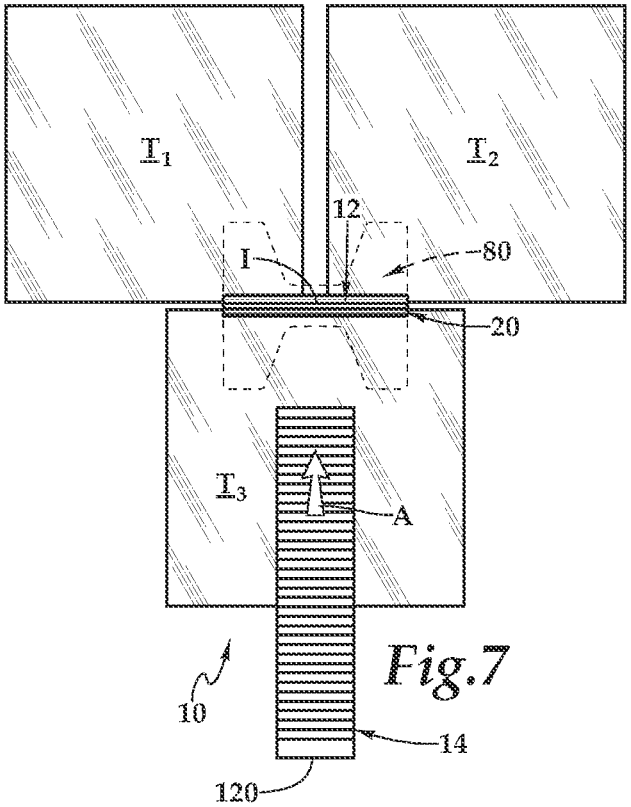
FIG. 7 is a top plan view of the tile leveling device with the leveling clip and wedge device presented in FIGS. 1A and 1B during installation of three tiles.
Figure 8:
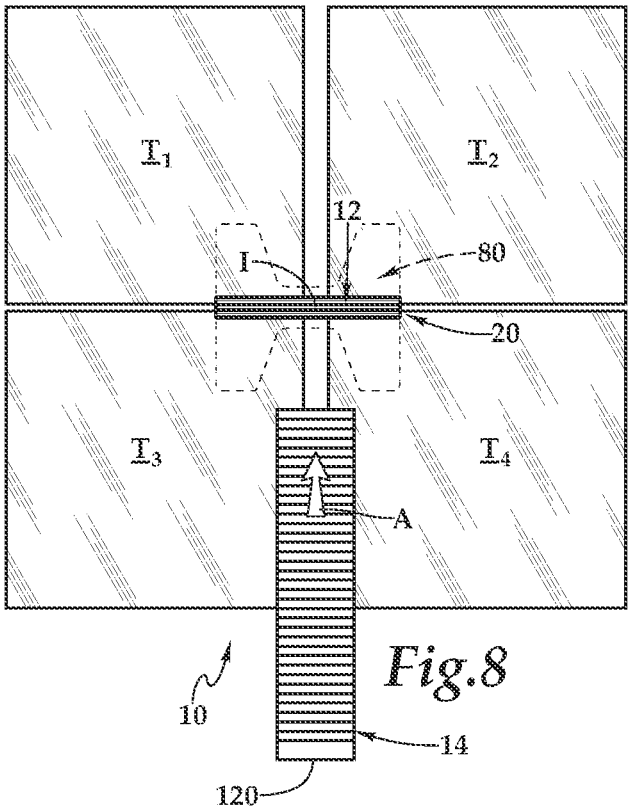
FIG. 8 is a top plan view of the tile leveling device with the leveling clip and wedge device presented in FIGS. 1A and 1B during installation of four tiles.

Referring now to FIG. 6, FIG. 7, and FIG. 8, the tile leveling device 10 presented herein may be used to align two, three or four tiles. A two-tile installation involving tiles $T_1$, $T_2$ is depicted in FIG. 6. A three-tile installation involving tiles $T_1$, $T_2$, $T_3$ is depicted in FIG. 7 and a four-tile installation involving tiles $T_1$, $T_2$, $T_3$, $T_4$ is depicted in FIG. 8. It is advantageous to an installer to be able to use only one tile leveling device 10 at an intersection I, instead of three or four clips, in order to save time and increase productivity. Additionally, with the use of only one tile leveling device 10 at the intersection I, costs are reduced. The legs 28, 30 and, in particular, the tapered surfaces 44, 64 defining the tapered legs afforded by the leveling clip 12 saves time and money over existing clip systems by permitting minimum effort to be employed to frangibly break the body 20 from the base 80 at the frangible breakaway section or frangible breakaway sections 92, 94 located below the tapered legs. One of the main drawbacks of traditional wedge and clip systems is the clips cannot be easily broken off. Tile installers need to be able to easily and quickly remove the upper portions of the clips while maintaining proper leveling and spacing between the tiles being installed.

Figure 9:
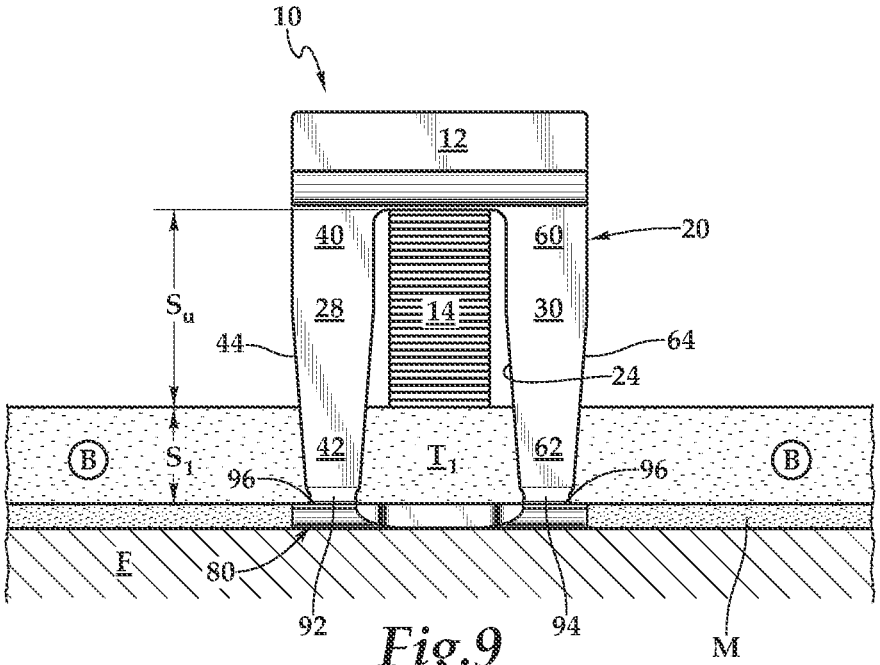
FIG. 9 is a front elevation view, in partial cross-section, of the tile leveling device presented in FIG. 6 during frangible separation of the leveling clip.
Figure 10:
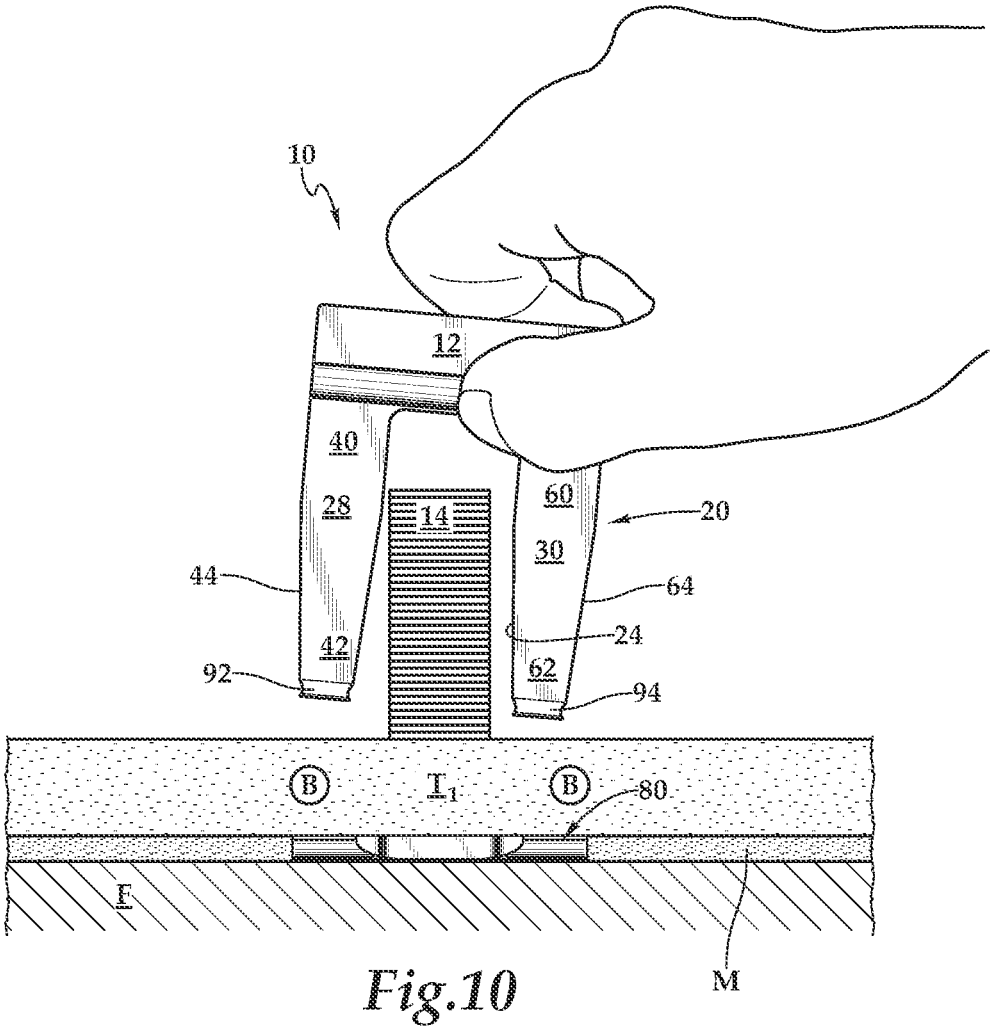
FIG. 10 is a front elevation view, in partial cross-section, of the tile leveling device presented in FIG. 6 following frangible separation of the leveling clip.

Referring now to FIG. 9 and FIG. 10, the tile leveling device 10 including the leveling clip 12 and the wedge device 14 has been utilized to align and space two, three, or four tiles, for example. With the separation of the body 20 from the base 80 of the leveling clip 12, this stage of the tile installation will be completed. As illustrated, the base to body coupling 96, including the frangible breakaway sections 92, 94, is integral prior to frangible separation and, as shown, the frangible breakaway sections 92, 94, upon breaking, frangibly separate the body 20 from the base 80. The leg 28 has the tapered surface 44 from the thick end 40 to the thin end 42. Similarly, the leg 30 has the tapered surface 64 from the thick end 60 to the thin end 62. The tapered surfaces 44, 64 of the legs 28, 30 encourage the breaking at the frangible breakaway sections 92, 94 with a minimal amount of force by the installer. Additionally, the tapered surfaces 44, 64 of the legs 28, 30 enhance the release of the leveling clip 12 from a bed B of mortar M, which hardens as the mortar M cures. That is, in one embodiment, the tapered surfaces 44, 64 of the legs 28, 30 traverse at least a mortar zone, shown as lower span $S_l$, on the body 20, which corresponds to the area of the body 20 which is within the bed B of mortar M during tile installation. The lower span $S_l$ extends on each of the legs 28, 30 from proximate the frangible breakaway sections 92, 94 to an upper span $S_u$, which may correspond to the surface of the tile $T_1$. The upper span $S_u$ represents the area of the legs 28, 30 adjacent to a portion of the opening 24 that accepts the wedge device 14 during installation of a tile, such as the tile $T_1$. It should be appreciated that the tapered portion of the legs 28, 30 may encompass the majority of the lower span, the lower span to the upper span, or at least the lower span by extending into the upper span. The use of a minimal amount of force is preferred as to avoid disturbing the placement of the tiles, which have the proper alignment and spacing.

Figure 11B:
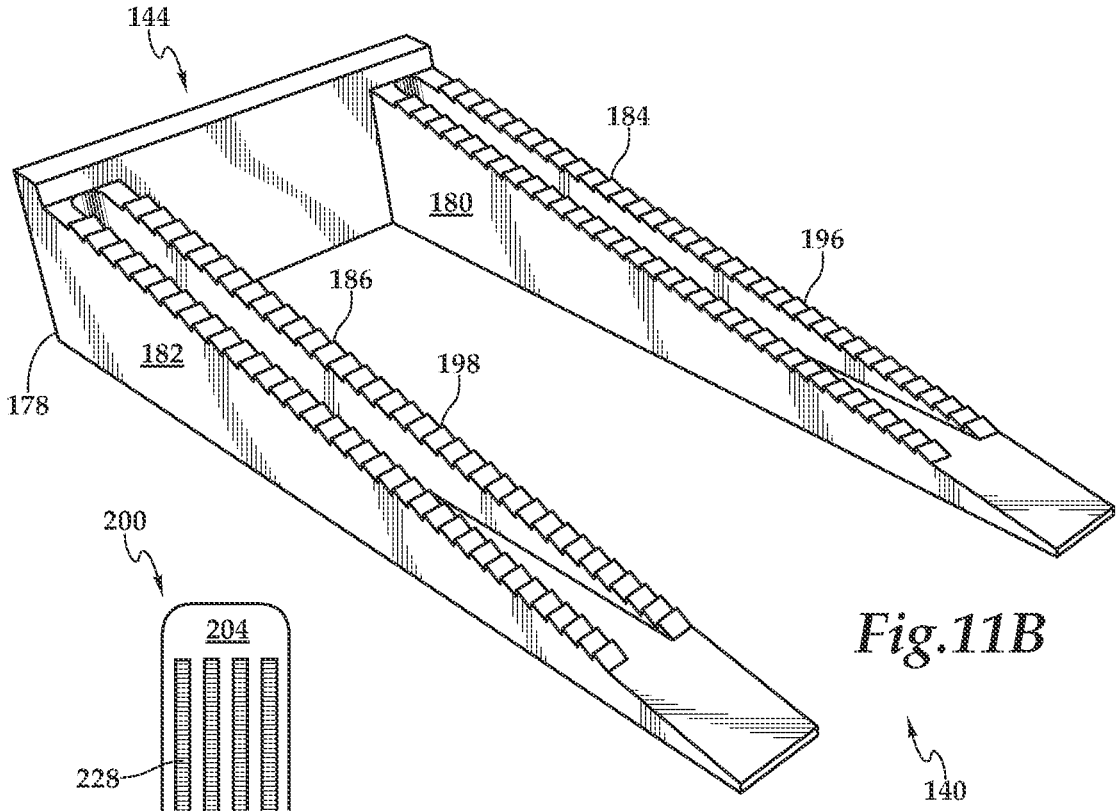
FIGS. 11A and 11B are front perspective views that, when taken together, form another embodiment of a tile leveling device including a leveling clip and a wedge device, according to the teachings presented herein.
Figure 11A:
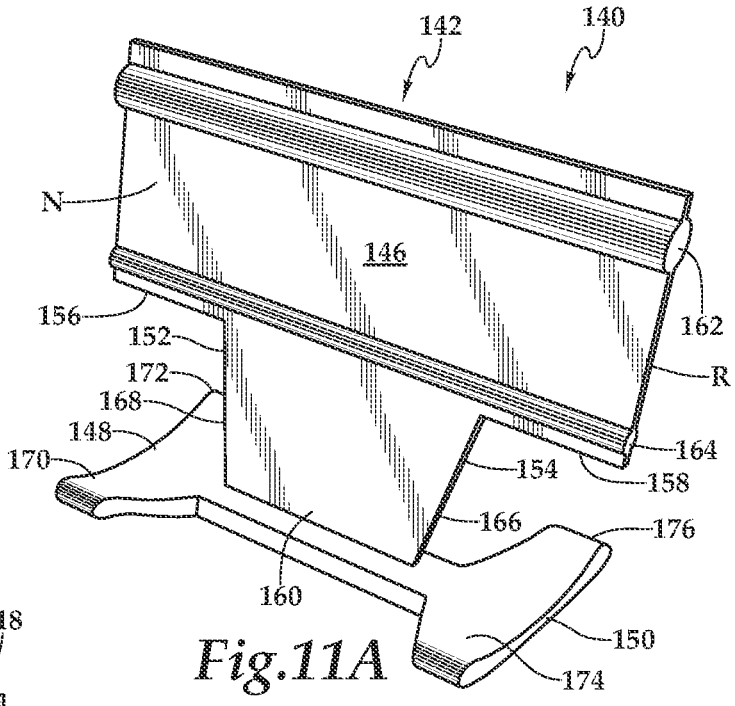
Figure 13A:
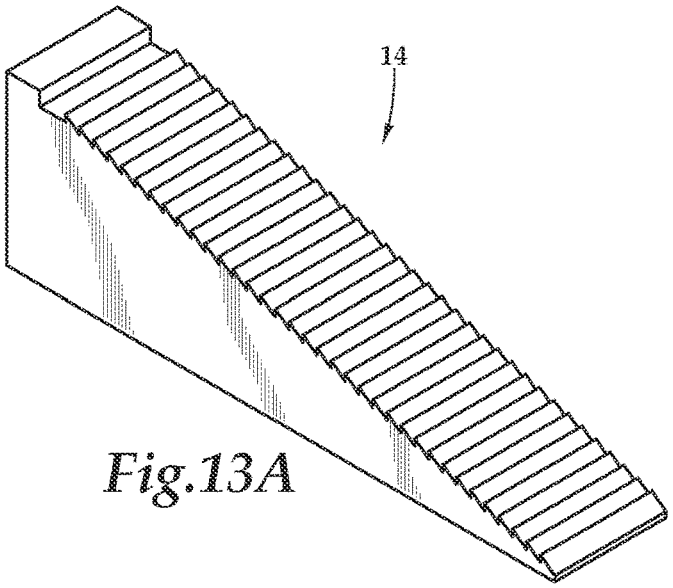
FIGS. 13A and 13B are front perspective views that, when taken together, form a still further embodiment of a tile leveling device including a leveling clip and a wedge device, according to the teachings presented herein.
Figure 13B:
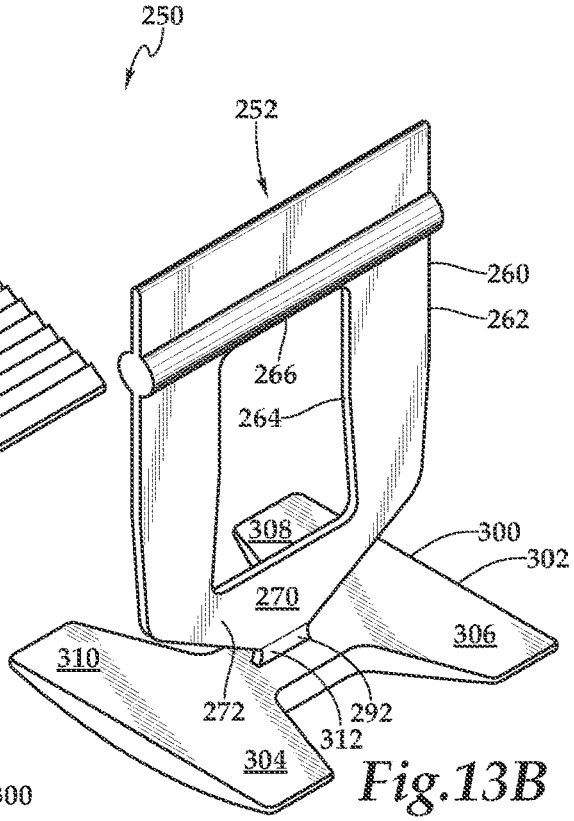
Figure 14:
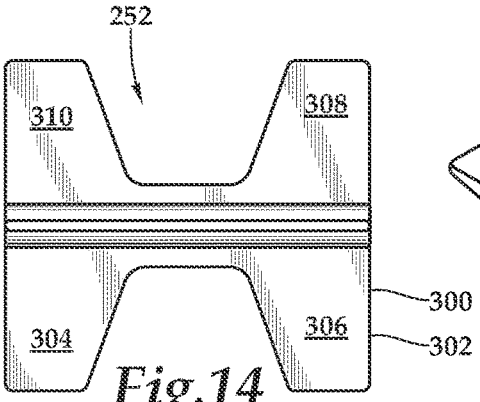
FIG. 14 is a top plan view of the leveling clip depicted in FIG. 13B.
Figure 15:
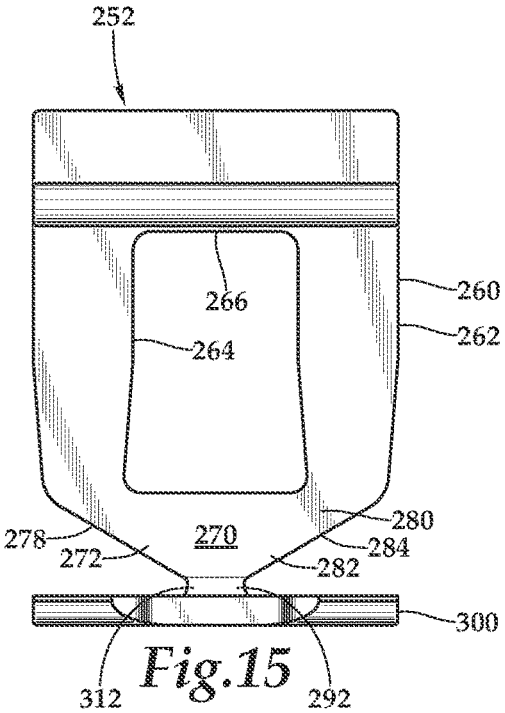
FIG. 15 is a front elevation view of the leveling clip depicted in FIG. 13B.
Figure 16:
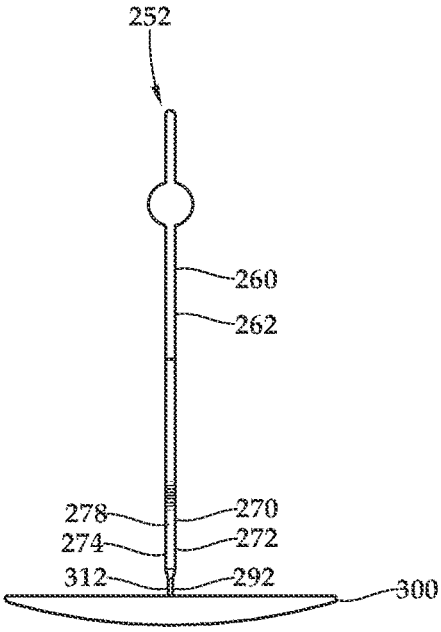
FIG. 16 is a side elevation view of the leveling clip depicted in FIG. 13B.

Referring initially to FIGS. 11A and 11B, therein is depicted another embodiment of a tile leveling device that is schematically illustrated and generally designated 140. The tile leveling device 140 includes a leveling clip 142 and a wedge device 144 that are utilized, in combination, to align and level two, three, or four tiles, for example. The leveling clip 142 includes a body 146 and spaced and parallel strip members 148, 150 extending transversely from the body 146. Each of the spaced and parallel strip members 148, 150 extend to the front N and rear R of the body 146. Lateral openings 152, 154 having upper edges 156, 158 are formed in the body 146 and sized to accept a member having a tapered surface configured to penetrate the respective lateral openings 152, 154 and exert force thereunder. A breakaway section 160 is defined along the body 146. The breakaway section 160 may be a frangible section of the body 146 of reduced thickness that would promote the breakaway, and thus, separation of the body 146. An upper bump 162 and a lower bump 164 extend horizontally across the body 146. The upper bump 162 being larger and more pronounced to provide lifting power.

As shown, the body 146 includes tapered surfaces 166, 168. It should be appreciated that although two tapered surfaces 166, 168 are depicted, the body 146 may have only one tapered surface. As previously discussed in other embodiments, the tapering of the body 146 enhances the release of the leveling clip 142 from the bed of mortar M, which hardens as the mortar M cures. The spaced and parallel strip members 148, 150 provide four points of contact 170, 172, 174, 176 for lift of tiles, while still establishing space for maximum mortar M penetration between the spaced and parallel strip members 148, 150.

The wedge device 144 includes a backstop member 178 and two extension members, depicted as wedge members 180, 182 extending from the backstop member 178. The backstop member 178 provides a push area for fingers or a thumb and an enhanced sized that furnishes more leverage during use. Each of the wedge members 180, 182 include respective tapered surfaces 184, 186 configured to penetrate the lateral openings 152,154 and exert force against the tiles by pressing the tiles against the strip members 148, 150. Teeth 196, 198 are located along the tapered surfaces 184, 186 in order to latch onto the respective upper edges 156, 158 of the opposing lateral openings 152, 154. In operation, the teeth 196, 198 prevent the respective wedge members 180, 182 from slipping out of the lateral openings 152, 154 during penetration thereof. As will be appreciated, the wedge device 144 may penetrate the leveling clip 142 from the front N or rear R.

Figure 12:
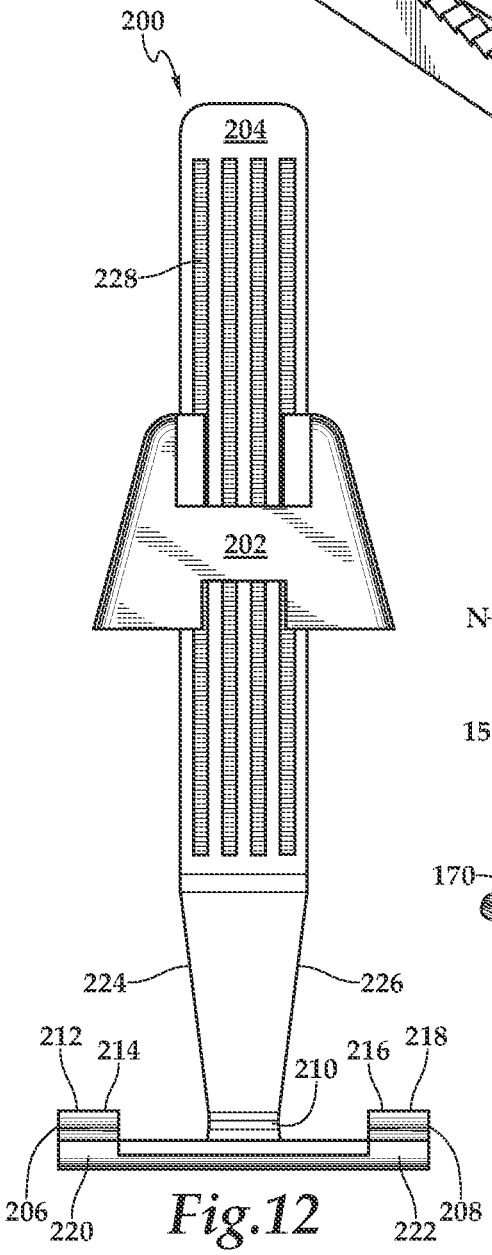
FIG. 12 is a front elevation view of a further embodiment of a leveling device, according to the teachings presented herein.

Referring now to FIG. 12, a tile leveling device 200 for use with a locking subassembly 202 are presented. As shown, the tile leveling device 200 includes a shaft 204 and spaced and parallel strip members 206, 208 extend transversely from the shaft 204. The locking subassembly 202 is configured to vertically traverse the shaft 204 and exert force against the tiles by pressing the tiles against the spaced and parallel strip members 206, 208, similar to the functionality described in previous embodiments. Each of the spaced and parallel strip members 206, 208 extend to the front and rear of the shaft 204. A frangible breakaway section 210 is defined along the shaft 204. The spaced and parallel strip members 206, 208 provide four points of contact 212, 214, 216, 218 for lift of tiles, while still establishing space for maximum mortar M penetration between the spaced and parallel strip members 206, 208. Convex curvatures 220, 222 ensure that the tiles of varying thicknesses may be leveled and aligned, including the alignment of up to four tiles of varying thickness. As shown, the shaft 204 includes tapered surfaces 224, 226. It should be appreciated that although two tapered surfaces 224, 226 are depicted, the shaft 204 may have only one tapered surface. As previously discussed in other embodiments, the tapering of the shaft 204 enhances the release of the tile leveling device 200 from the bed of mortar M, which hardens as the mortar M cures.

In operation, once the tiles are properly positioned, the locking subassembly 202 is secured in its place above the tiles and prevented from moving along the shaft 204 before being driven down to compress the tiles. The shaft 204 may include a locking surface 228, such as a "zip tie" to enable movement along the shaft 204 by the locking subassembly 202 in only one direction, in other words, toward the tiles.

Referring to FIG. 13A, FIG. 13B, FIG. 14, FIG. 15, and FIG. 16, therein is depicted another embodiment of a tile leveling device schematically illustrated and generally designated 250. The tile leveling device 250 is utilized with a leveling clip 252 and the wedge device 14 to, in combination, align and level two, three, or four tiles, for example. In one embodiment, the leveling clip 252 includes a body, which is depicted as a body 260 defining an opening 264, having an upper edge 266. The body 260 may have one leg 270 extending therefrom. As shown, in one embodiment, the opening 264 may be positioned proximate the leg 270. That is, in general, the body may have one leg or two legs (see previous embodiments) and the body 260 has one leg 270. The leg 270 includes a front portion 272, a rear portion 274, and an outside portion 278. In some embodiments, as shown best in FIG. 15, the front portion 272 presents a thick end 280 and a thin end 282 with a tapered surface 284 therebetween. Similarly, the rear portion 274 presents the thick end 280 and the thin end 282 with the tapered surface 284 therebetween. It should be appreciated that in one embodiment, the body 260 is tapered from the thick end 280 to the thin end 282 with the thick end 280 being superior to the thin end 282.

As previously discussed, the tapering of the leg 270 enhances the release of the leveling clip 252 from the mortar M, which hardens into a bed as the mortar M cures. In one implementation, the tapering of the leg 270 may begin at the point where the leg 270 of the leveling clip 252 intersect the top edge of the tile, when in use, and the tapering may continue to a frangible breakaway section 292. A base 300, which is shown as an I-shaped base 302 is orthogonally coupled to the body 260 such that four spaced bars 304, 306, 308, 310 extend transversely from the body 260. The frangible breakaway section 292 is defined along the leg 270 of the body 260 and provides a base to body coupling 312.

Figure 17:
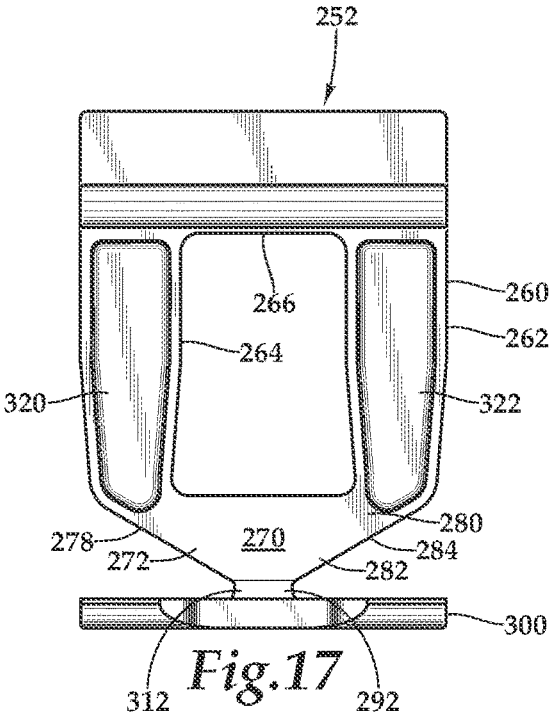
FIG. 17 is a front elevation view of another embodiment of a tile leveling clip for the leveling device depicted in FIGS. 13A and 13B, according to the teachings presented herein.
Figure 18:
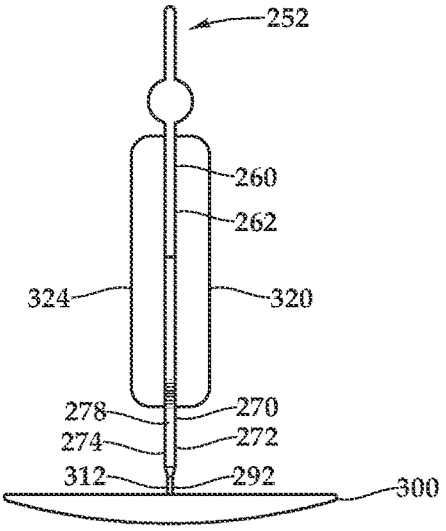
FIG. 18 is a side elevation view of the leveling clip depicted in FIG. 17.

Referring now to FIGS. 17 and 18, spacing pads 320, 322, 324 (n.b., three of four spacing pads depicted) may optionally be integral with the body 260, or any other embodiment of the leveling clip and tile leveling device presented herein, such that the front portion 272 and the rear portion 274 of the leg 270, for example, and may vary in thickness depending on the application. By way of further detail, the spacing pads 32, 322 are affixed to the front portion 272 of the leg 270 and the spacing pad 324 is affixed to the rear portion 274 of the rear portion 274. The spacing pads 320, 322, 324 contribute to furnishing a combination of vertical leveling and joint spacing within a single product. Moreover, the spacing pads 320, 322, 324, which may be more generally a spacer, is configured to position the tiles a predetermined distance apart depending on the application. It should be appreciated that although four spacing pads are suggested in the embodiment presented in FIGS. 17-18, any number and configuration of spacing pads may be utilized and are within the teachings presented herein.

Figure 19:
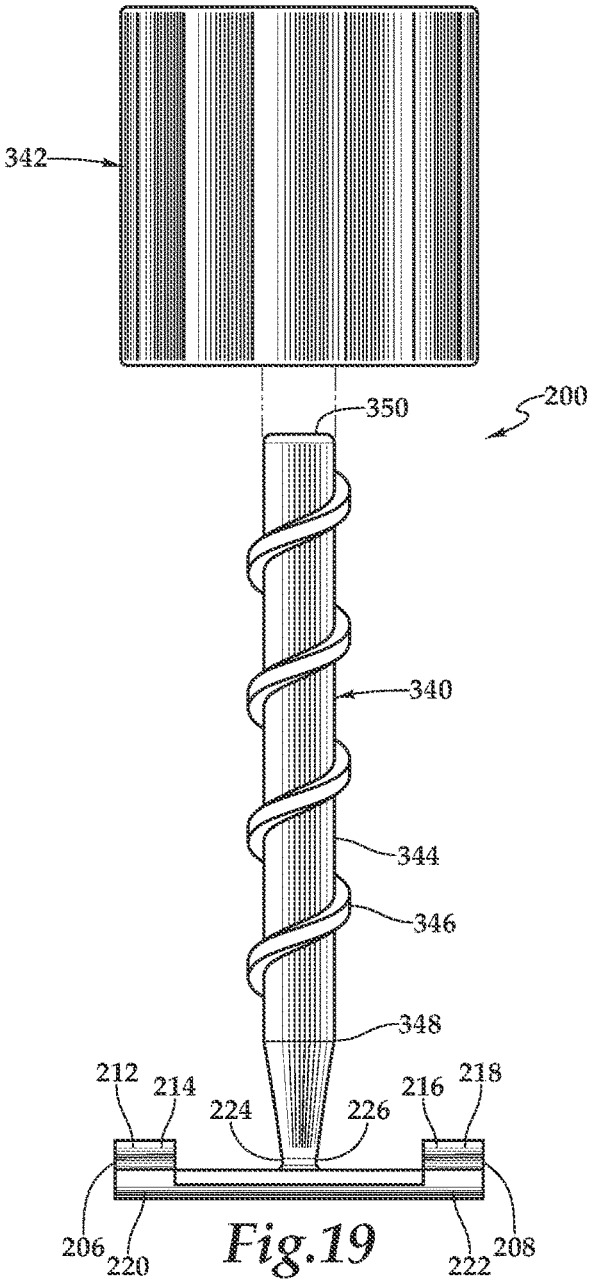
FIG. 19 is a front elevation view of still another embodiment of a leveling device, according to the teachings presented herein.
Figure 20:
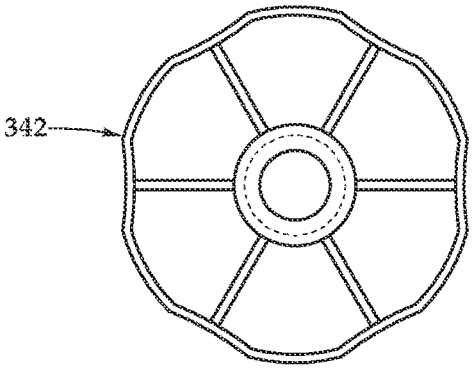
FIG. 20 is top plan view of one embodiment of a knob, which forms a portion of the leveling device depicted in FIG. 19.

Referring now to FIGS. 19 and 20, another embodiment of the tile leveling device 200 is depicted, which includes a shaft 340 and a knob 342, which is a form of locking subassembly 202. As shown, the shaft 340 includes a stem 344 having a thread 346 thereround from a lower end 348 to an upper end 350. The knob 342 is configured to vertically traverse the shaft 340, by a screw-action, and exert force against the tiles by pressing the tiles against the spaced and parallel strip members 206, 208, similar to the functionality described in previous embodiments. As shown, the shaft 340 includes the tapered surfaces 224, 226. It should be appreciated that although two tapered surfaces 224, 226 are depicted, the shaft 340 may have only one tapered surface. As previously discussed in other embodiments, the tapering of the shaft 340 enhances the release of the tile leveling device 200 from the bed of mortar M, which hardens as the mortar M cures.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A tile leveling device comprising:

a leveling clip comprising:

a body defining an opening, the body including a first leg and a second leg extending therefrom, the first leg and the second leg each include:

a front portion, a rear portion, an inside portion, and an outside portion, a lower span extending from proximate the frangible breakaway section to an upper span, and the upper span being an area adjacent to a portion of the opening where, in response to tile installation, the wedge penetrates the opening, the first leg and the second leg each being tapered at the inside portion and the outside portion from a thick end to a thin end through the lower span, the thick end being superior to the thin end, a base coupled to the body, the base extending to a front of the body and the base extending to a rear of the body, a base to body coupling including a frangible breakaway section, the base and the body being integral prior to frangible separation, the frangible breakaway section upon breaking, frangibly separating the body from the base, the base to body coupling being located at an intersection of the thin end of the first leg and the base; and a wedge device comprising:

a backstop member, and a wedge member extending from the backstop member, the wedge member having a tapered surface penetrating the opening of the body of the leveling clip, the wedge member configured to exert force against tiles being installed.

2. The tile leveling device as recited in claim 1, wherein the second leg is tapered from a thick end to a thin end, the thick end being superior to the thin end.

3. The tile leveling device as recited in claim 1, wherein the body further comprises an inverted U-shaped body.

4. The tile leveling device as recited in claim 1, wherein the base is orthogonally coupled to the body.

5. The tile leveling device as recited in claim 1, wherein the base further comprises:

an I-shaped base orthogonally coupled to the body, the I-shaped base having spaced first, second, third, and fourth bars extending transversely from the body, the spaced first and second bars extending to the front and outward of the body and the spaced third and fourth bars extending to the rear and outward of the body;

a first notch formed between the first and second bars; and a second notch formed between the first and second bars.

6. The tile leveling device as recited in claim 1, wherein the first leg and the second leg are each tapered through at least the lower span and into the upper span.

7. The tile leveling device as recited in claim 1, wherein the first leg and the second leg are each tapered through a majority of the lower span.

8. The tile leveling device as recited in claim 1, wherein the lower span corresponds to an area of the body which is within a bed of mortar during tile installation.

9. A leveling clip for a tile leveling device, the leveling clip comprising:

a body defining an opening, the body including a first leg and a second leg extending therefrom, the first leg and second leg each include:

a front portion, a rear portion, an inside portion, and an outside portion, a lower span extending from proximate the frangible breakaway section to an upper span, and the upper span being an area adjacent to a portion of the opening where, in response to tile installation, the wedge penetrates the opening, the first leg being tapered at the inside portion and the outside portion from a thick end to a thin end through the lower span, the thick end being superior to the thin end;

a base coupled to the body, the base extending to a front of the body and the base extending to a rear of the body;

a base to body coupling including a frangible breakaway section, the base and the body being integral prior to frangible separation, the frangible breakaway section upon breaking, frangibly separating the body from the base; and the base to body coupling being located at an intersection of the thin end of the first leg and the base.

10. The tile leveling device as recited in claim 9, wherein the first leg and the second leg are each tapered through at least the lower span and into the upper span.

11. The tile leveling device as recited in claim 9, wherein the lower span corresponds to an area of the body which is within a bed of mortar during tile installation.

* * * * *